US009430961B2

(12) United States Patent
Kim et al.

(10) Patent No.: US 9,430,961 B2
(45) Date of Patent: Aug. 30, 2016

(54) DATA DRIVER

(71) Applicants: Chang Woon Kim, Gwangju-si (KR); Kwang Jin Lee, Guri-si (KR)

(72) Inventors: Chang Woon Kim, Gwangju-si (KR); Kwang Jin Lee, Guri-si (KR)

(73) Assignee: Dongbu HiTek Co., Ltd., Bucheon-si (KR)

( * ) Notice: Subject to any disclaimer, the term of this patent is extended or adjusted under 35 U.S.C. 154(b) by 159 days.

(21) Appl. No.: 14/172,507

(22) Filed: Feb. 4, 2014

(65) Prior Publication Data

US 2015/0109354 A1 Apr. 23, 2015

(30) Foreign Application Priority Data

Oct. 21, 2013 (KR) ..... 10-2013-0125211

(51) Int. Cl.
*G09G 1/00* (2006.01)
*G09G 3/20* (2006.01)

(52) U.S. Cl.
CPC ..... *G09G 3/2003* (2013.01); *G09G 2310/027* (2013.01); *G09G 2310/0289* (2013.01); *G09G 2310/0291* (2013.01)

(58) Field of Classification Search
CPC .... G09G 3/36; G09G 3/3648; G09G 3/2003; G09G 2310/027; G09G 2310/0289; G09G 3/3275; G09G 3/2022
See application file for complete search history.

(56) References Cited

U.S. PATENT DOCUMENTS 6,922,189 B2 7/2005 Fujiyoshi
7,616,183 B2 11/2009 Choi
8,018,444 B2 9/2011 Park et al.
2003/0006978 A1 1/2003 Fujiyoshi
2006/0139286 A1* 6/2006 Kida ..... G09G 3/3688 345/98
2006/0146000 A1 7/2006 Choi
2007/0091031 A1* 4/2007 Park ..... G09G 3/3275 345/76
2015/0015472 A1* 1/2015 Nakayama ..... G09G 3/3688 345/98

FOREIGN PATENT DOCUMENTS

KR 100493216 B1 6/2005
KR 100611509 B1 8/2006
KR 100662985 B1 12/2006
KR 1020070083126 A 8/2007

OTHER PUBLICATIONS

Office Action dated Oct. 21, 2015, for Korean Patent Application No. 10-2013-0125211; 5 pgs.; Korean Intellectual Property Office, Republic of Korea.

Soo Jin Choi et al.; Apparatus of Source Driving and Display Device Having the Same; Abstract of KR10-2007-0083126; 2 pgs.; http://engpat.kipris.or.kr.

(Continued)

*Primary Examiner* — Michael Faragalla
(74) *Attorney, Agent, or Firm* — Andrew D. Fortney; Central California IP Group, P.C.

(57) ABSTRACT

A data driver is disclosed. The data driver includes a first latch unit including a plurality of first latches configured to store data, a selector configured to select and/or output data in two or more first latches, a level shifter unit configured to convert a voltage level of the data in the two or more selected first latches and output the voltage level-converted data, and a second latch unit including a plurality of second latches configured to store the voltage level-converted data.

15 Claims, 4 Drawing Sheets

(56) References Cited

OTHER PUBLICATIONS

Young Sung Park et al.; Data Driving Circuit and Driving Method of Organic Light Emitting Display Using the Same; Abstract of KR10-0662985; 2 pgs.; http://engpat.kipris.or.kr.

Chang Hwe Choi; Source Driving Circuit of a Liquid Crystal Display Device and Method for Driving Source Thereof; Abstract of KR10-0611509; 2 pgs.; http://engpat.kipris.or.kr.

Tatsumi Fujiyoshi; Circuit for Driving Image Signal and Display Device Having the Same; Abstract of KR10-0493216; 2 pgs.; http://engpat.kipris.or.kr.

* cited by examiner

DATA DRIVER

This application claims the benefit of Korean Patent Application No. 10-2013-0125211, filed on Oct. 21, 2013, which is hereby incorporated by reference as if fully set forth herein.

BACKGROUND OF THE INVENTION

1. Field of the Invention

The present invention relates to a data driver.

2. Discussion of the Related Art

In general, a data driver may include a first latch configured to store data from pixels in a display panel in a synchronous manner, a second latch configured to store the data from the first latch in units of a horizontal line period, a level shifter configured to convert the voltage level of the data from the second latch, a digital-to-analog converter configured to convert the data output from the level shifter into an analog voltage, and an amplifier configured to amplify the converted analog voltage.

If the resolution of a display panel increases, the size and/or number of the data drivers may increase, and thus chip manufacturing costs may also increase.

SUMMARY OF THE INVENTION

Accordingly, the present invention is directed to a data driver that substantially obviates one or more problems due to limitations and disadvantages of the related art.

An object of the present invention is to provide a data driver capable of reducing the size thereof without a reduction in performance, and thus reducing manufacturing costs of a corresponding chip.

Additional advantages, objects, and features of the invention will be set forth in part in the description which follows and in part will become apparent to those skilled in the art upon examination of the following or may be learned from practice of the invention. The objectives and other advantages of the invention may be realized and attained by the structure(s) particularly pointed out in the written description and claims hereof, as well as the appended drawings.

To achieve these objects and other advantages and in accordance with the purpose of the invention, as embodied and broadly described herein, a data driver includes a first latch unit including a plurality of first latches configured to store data, a selector configured to select and/or output data in two or more of the first latches, a level shifter unit configured to convert a voltage level of the data in the two or more first latches and output the voltage level-converted data, and a second latch unit including a plurality of second latches configured to store the voltage level-converted data.

The second latch unit may have a driving or operational voltage higher than a driving or operational voltage of the first latch unit.

The first latch unit may comprise a plurality of first groups, each including two or more first latches, and the level shifter unit may include a plurality of level shifters respectively corresponding to the first groups.

The number of level shifters may be less than the number of first latches.

The selector may simultaneously provide the data from one of the first latches in each first group to a corresponding level shifter.

Each of the first groups may include three first latches, and the first latches in each first group may respectively store red (R), green (G), and blue (B) data (e.g., pixel data).

The second latch unit may comprise a plurality of second groups each including two or more second latches.

The second groups may respectively correspond to the plurality of level shifters, and the data output from each level shifter may be stored in one of the second latches included in a second group corresponding to a respective one of the level shifters.

The selector may include a plurality of switches, each switch being between one of the first latches in each first group and a level shifter corresponding to the first group.

The selector may sequentially provide the data from the first latches in each first group to a level shifter corresponding to the first group.

The data driver may further include a timing controller configured to generate first control signals that control operations of the switches.

The timing controller may generate second control signals that simultaneously enable one of the second latches in each second group.

Each of the second control signals may be enabled after an enable timing of a corresponding one of the first control signals, and be disabled before a disable timing of the corresponding first control signal.

The data driver may further include a digital-to-analog converter configured to convert an output of the second latch unit into an analog signal, and an output unit configured to amplify the analog signal from the digital-to-analog converter, and output the amplified analog signal.

In another aspect of the present invention, a data driver includes a first latch unit including a plurality of first latches configured to store data, a selector configured to select two or more of the first latches, a level shifter unit configured to convert a voltage level of input data and output the voltage level-converted data, a second latch unit including a plurality of second latches configured to store the voltage level-converted data from the level shifter unit, a digital-to-analog converter configured to convert an output of the second latch unit into an analog signal, and an output unit configured to amplify the analog signal from the digital-to-analog converter, and output the amplified analog signal, wherein the selector provides the data from the two or more first latches to the level shifter unit.

The first latch unit may comprise a plurality of first groups, each including two or more first latches, and the level shifter unit may include a plurality of level shifters respectively corresponding to the first groups.

One of the level shifters corresponding to each first group may perform a level shifting operation on (e.g., shift the voltage level of) the data in the first latches in the first group for one horizontal line period.

The second latch unit may comprise a plurality of second groups each including two or more second latches.

The number of level shifters may be equal to the number of first groups.

The selector may sequentially select the first latches in each first group and provide the data from the selected first latches to a level shifter corresponding to the first group.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle(s) of the invention. In the drawings.

DETAILED DESCRIPTION OF THE INVENTION

Figure 1:
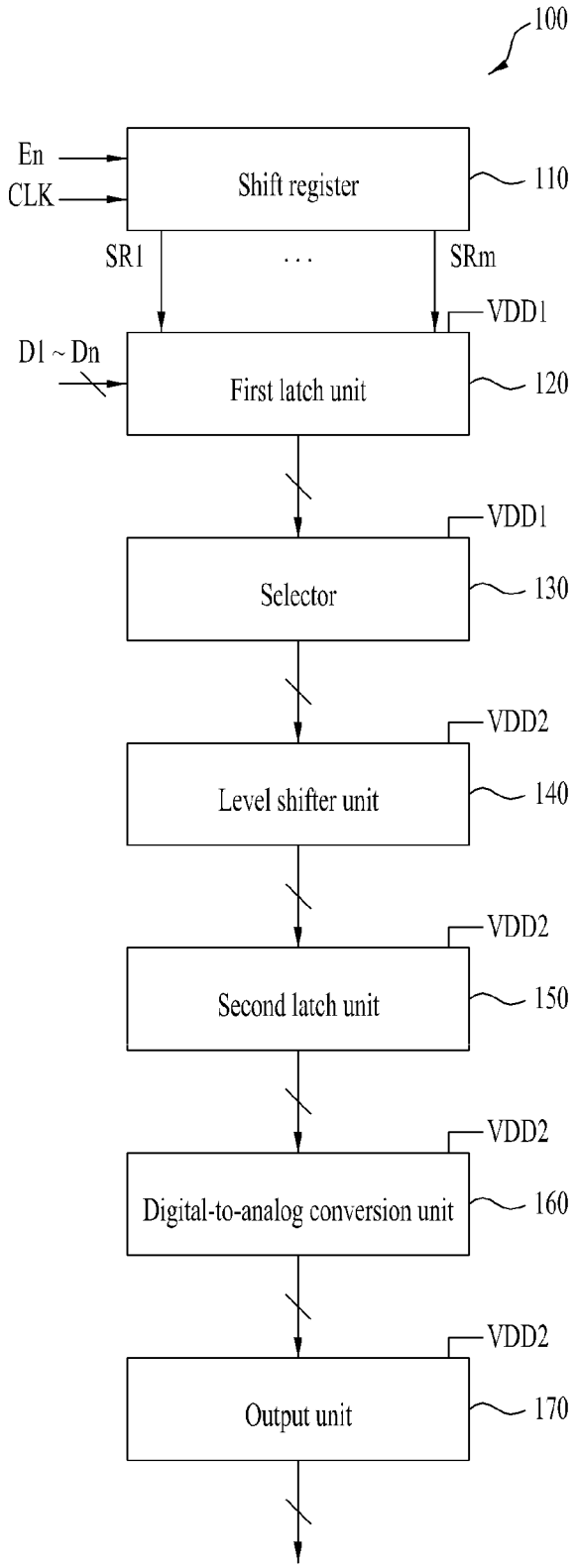
FIG. 1 is a block diagram of a data driver according to one or more embodiments of the present invention.

Reference will now be made in detail to various embodiments of the present invention, examples of which are illustrated in the accompanying drawings. It will be understood that when an element such as a layer (film), a region, a pattern, or a structure is referred to as being "on" or "under" another element, it can be directly on or under the other element without any intervening element, or be indirectly on or under the other element with one or more intervening elements. In addition, the concepts of "on" or "under" are defined with reference to the drawings.

In the drawings, dimensions of constituent elements may be exaggerated, omitted or schematically illustrated for clarity and convenience of description. In addition, the dimensions of various elements do not entirely or necessarily reflect actual dimensions thereof. Wherever possible, the same reference numbers will be used throughout the drawings to refer to the same or like parts.

FIG. 1 is a block diagram of a data driver 100 according to one or more embodiments of the present invention.

Referring to FIG. 1, the data driver 100 includes a shift register 110, a first latch unit 120, a selector 130, a level shifter unit 140, a second latch unit 150, a digital-to-analog converter 160, and an output unit 170.

The shift register 110 generates signals SR1 to SRm (m being a natural number that satisfies m>1) in response to an enable signal En and a clock signal CLK. The signals SR1 to SRm may be shift signals, or latch control signals. The clock signal CLK is configured to control timing of functions or operations (e.g., sequentially and/or simultaneously storing data, for example, digital image data) in the shift register 110 and/or the first latch unit 120. Here, the term "shift signal" may be used interchangeably with the term "start pulse," and the clock signal CLK may function as both a timing signal and a data signal in the shift register 110.

For example, the shift register 110 may receive a start signal (e.g., a horizontal start signal) from a timing controller (not shown) and shift the received start signal and/or data in the shift register 110 in response to the clock signal CLK (e.g., to generate the signals SR1 to SRm). The shift register 110 in general operates in the same or substantially similar manner as a conventional shift register, except as otherwise described herein.

The first latch unit 120 stores data D1 to Dn (n being a natural number that satisfies n>1) received from an external source (e.g., an image or other sensor, the timing controller, etc.) in response to the shift signals SR1 to SRm from the shift register 110. Data D1 to Dn may represent an n-bit-wide parallel data signal, n parallel single-bit data signals, or q groups of n/p parallel data signals, where q×p=n.

The first latch unit 120 may include a plurality of first latches respectively configured to store the data D1 to Dn.

The driving or operational voltage of the first latch unit 120 may be a first voltage VDD1.

For example, the data D1 to Dn received from the external source may comprise red (R), green (G), and blue (B) data (or a plurality of groups of such RGB data), and the first latches of the first latch unit 120 may store the R, G, and B data.

The selector 130 selects two or more of the data D1 to Dn stored in the first latch unit 120 and provides the two or more selected data to the level shifter unit 140.

For example, the selector 130 may select two or more of the first latches and provide data stored in the two or more selected first latches to the level shifter unit 140. In further embodiments, the selector 130 selects three or more latches, or one or more groups of three latches, for example to output the RGB data in each group of three latches to the level shifter unit 140.

The level shifter unit 140 converts the voltage level of the data provided from the selector 130. For example, the level shifter unit 140 may convert the data provided from the selector 130 and having a first voltage level, into data having a second voltage level.

For example, the driving voltage of the level shifter unit 140 may be a second voltage VDD2, and the second voltage level may be higher than the first voltage level (e.g., VDD1).

The driving or operational voltage VDD2 of the level shifter unit 140 may be higher than the driving or operational voltage VDD1 of the first latch unit 120.

The level shifter unit 140 may include a plurality of level shifters, and the number of level shifters may be less than the number of first latches.

The selector 130 may provide the data from the two or more selected first latches to the level shifters of the level shifter unit 140 sequentially or simultaneously, at a predetermined time interval. For example, the predetermined time interval may be the period of the clock signal CLK, or an a/b multiple of the period of the clock signal CLK, where a and b are each different integers of 1 or more. In some embodiments, one of a and b is 3 or a multiple thereof.

The first latches may be grouped into a plurality of first groups (e.g., groups of first latches), each group including two or more (for example, 3) first latches.

For example, the data stored in the three first latches included in each first group may be R, G, and B data.

The selector 130 may simultaneously provide the data in one of the three first latches in each first group to a corresponding level shifter (e.g., in such a manner that the data of corresponding first latches of the respective first group[s] are simultaneously provided to the level shifters).

The number of level shifters may be equal to the number of first groups of first latches. Each of the level shifters may perform a level shifting operation on (e.g., changing the voltage level of) the data from the first latches in each first group.

For one horizontal line period (e.g., corresponding to a horizontal line of an image sensor or other data stored or transferred in or as an x-by-y array of rows and columns), each level shifter may perform the level shifting operation on the data from the three first latches in each first group. That is, for one horizontal line period, each level shifter may perform the level shifting operation a number of times (for example, three times) corresponding to the number of first latches included in each first group (for example, 3).

The second latch unit 150 stores the data from the level shifter unit 140. The second latch unit 150 may store the data from the level shifter unit 140 in units of a horizontal line period (e.g., a row of data, such as from an image sensor).

For example, a horizontal line period may refer to a time taken to completely store data corresponding to one horizontal line of an image sensor or other device such as a display panel that stores and/or organizes data in an array.

The second latch unit 150 may include a plurality of second latches, and the number of second latches may be greater than the number of level shifters and be equal to the number of first latches.

The digital-to-analog converter 160 converts an output of (e.g., data from) the second latch unit 150 (that is, digital data) into an analog signal.

For example, the digital-to-analog converter 160 may receive grayscale voltages Ref generated by a power supply 165 (see FIG. 2), and convert the output of the second latch unit 150 into an analog signal. For example, the power supply 165 may include a plurality of resistors connected in series between a power supply voltage source VDD2 and a ground voltage source GND, and generate the grayscale voltages Ref having a plurality of levels (for example, $2^n$ levels, where n is an integer of at least 5). In one implementation, the grayscale voltages Ref have 256 levels.

The output unit 170 amplifies (or buffers) the analog signal from the digital-to-analog converter 160 and outputs the amplified (or buffered) analog signal.

In general, level shifters and first latches of a data driver may have a one to one correspondence, and the number of level shifters may be equal to the number of first latches and second latches.

However, according to embodiments of the present disclosure, since one level shifter performs a level shifting operation on data stored in a plurality of (for example, 3) first latches, the size of the data driver may be reduced without a reduction in performance, and thus chip manufacturing costs may also be reduced.

Figure 2:
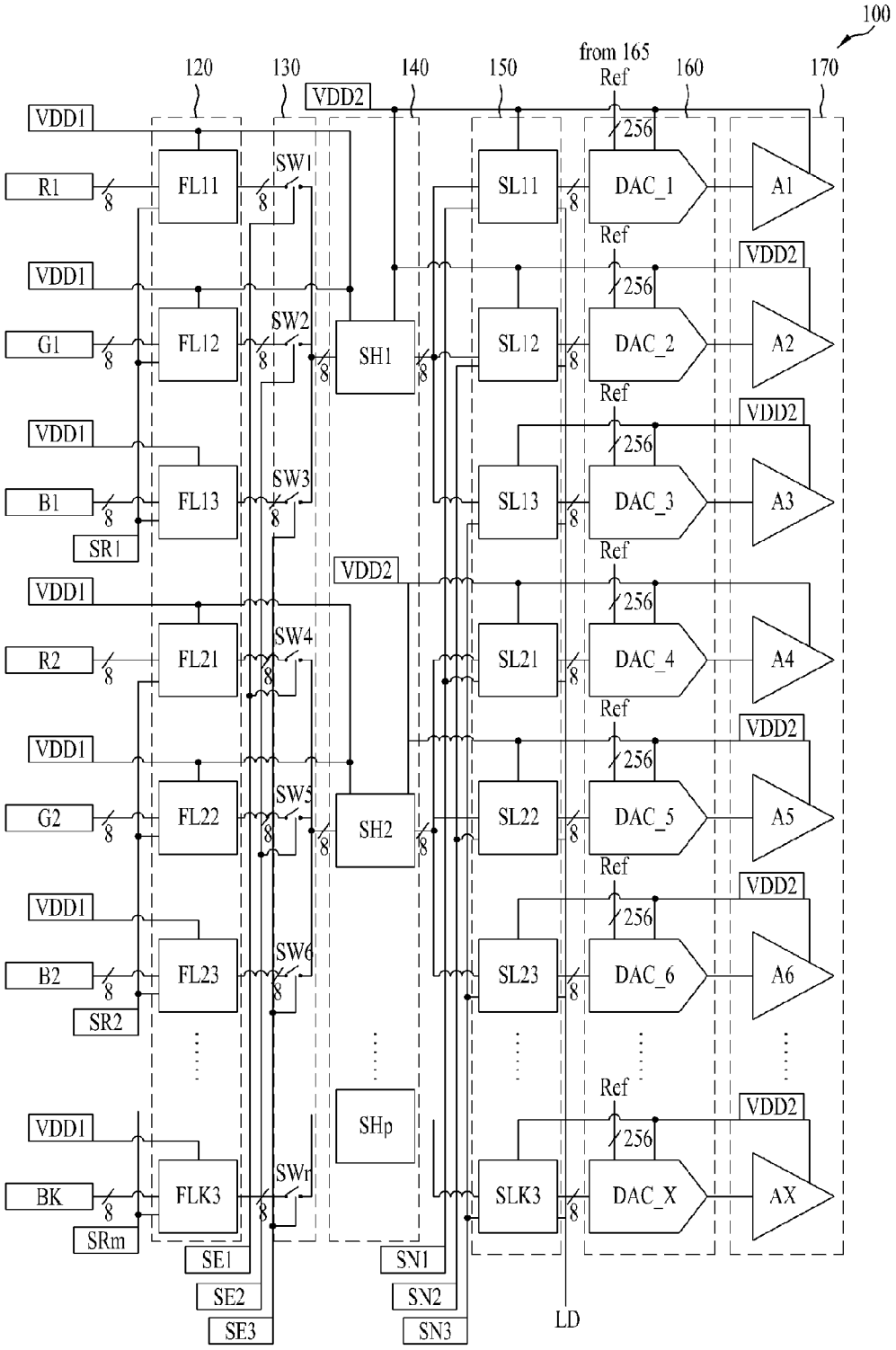
FIG. 2 is an exemplary circuit diagram for the data driver illustrated in FIG. 1.

FIG. 2 is an exemplary circuit diagram for the data driver 100 illustrated in FIG. 1.

Like reference numerals in FIGS. 1 and 2 denote like elements, and descriptions thereof will be omitted or briefly provided.

Referring to FIG. 2, the first latch unit 120 may include a plurality of first latches FL11 to FLk3 (k being a natural number that satisfies k>1). The first latches FL11 to FLk3 may be grouped into a plurality of (for example, k, where k is a natural number that satisfies k>1) first groups. In some implementations, k is a number equal to the number of pixels in a row or horizontal line of an image sensor or display.

Each first group may include a plurality of first latches (for example, FLk1, FLk2, and FLk3, where k is a natural number that satisfies k>1), and the first latches FL11 to FLk3 included in each first group do not overlap.

For example, three first latches (e.g., FL11 to FL13, FL21 to FL23, or FLk1 to FLk3, etc.) included in each first group may store R, G, and B data (for example, Rk, Gk, and Bk, where k is a natural number that satisfies k>1).

A $1^{st}$ first latch (for example, FLk1) included in each first group may store R data (for example, Rk), a $2^{nd}$ first latch (for example, FLk2) may store G data (for example, Gk), and a $3^{rd}$ first latch (for example, FLk3) may store B data (for example, Bk). Each of the R data, G data, and B data may have Q bits (Q being a natural number that satisfies Q>1, for example, Q=8), which may define its intensity and/or shade.

The first latch unit 120 may store data D1 to Dn (n being a natural number that satisfies n>1; see the above description of data D1 to Dn) in response to shift signals SR1 to SRm (m being a natural number that satisfies m>1).

For example, each of the shift signals SR1 to SRm (for example, SR1) may be simultaneously provided to the first latches (for example, FL11, FL12, and FL13) in a corresponding first group. Thus, data R1, G1, and B1 may be simultaneously stored in the first latches FL11, FL12, and FL13 in response to the shift signal SR1, data R2, G2, and B2 may be simultaneously stored in the first latches FL21, FL22, and FL23 in response to the shift signal SR2, etc.

The selector 130 may provide the data stored in one of the first latches in each first group to a corresponding level shifter. For example, the data of the first latches of the respective first groups (e.g., FL11, FL21, FLk1) are simultaneously provided to the level shifters.

In addition, the selector 130 may provide the data in the first latches in each first group to the level shifter corresponding to the first group sequentially or at a predetermined time interval.

The selector 130 may simultaneously select one of the first latches in each first group (e.g., FL11, FL21, . . . FLk1) in response to a first control signal (e.g., SE1) received from the timing controller, and electrically connect the selected first latch to a corresponding level shifter (e.g., SH1, SH2, . . . SHp). For example, corresponding first latches of the respective first groups are simultaneously connected to the level shifters. Then, the selector 130 may simultaneously select another one of the first latches in each first group (e.g., FL12, FL22, . . . FLk2) in response to another control signal (e.g., SE2) received from the timing controller, and electrically connect the selected first latch to the corresponding level shifter (e.g., SH1, SH2, . . . SHp). When each group of first latches includes a third unit, the selector 130 may then simultaneously select a third one of the first latches in each first group (e.g., FL13, FL23, . . . FLk3) in response to a third control signal (e.g., SE3) received from the timing controller, and electrically connect the selected first latch to the corresponding level shifter (e.g., SH1, SH2, . . . SHp).

Although three first control signals (for example, SE1 to SE3) are illustrated in FIG. 2, the number of first control signals is not limited thereto and may be equal to the number of first latches included in each first group.

The selector 130 may include a plurality of switches SW1 to SWn (n being a natural number that satisfies n>1, as described above). Each of the switches SW1 to SWn may be between one of the first latches (e.g., in a corresponding first group) and a level shifter corresponding to the first group.

One of the first control signals SE1 to SE3 (for example, SE1) may simultaneously control a switch (for example, SW1) between one of the first latches (for example, FL11) in each first group and a corresponding level shifter (for example, SH1). For example, switches corresponding to a particular first latch in a group (for example, SW1, SW4, . . . SWn−2) are simultaneously controlled.

Figure 4:
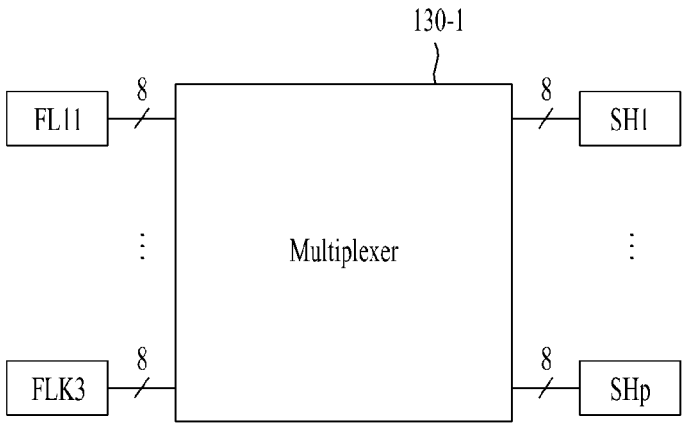
FIG. 4 is a view illustrating a selector according to one or more additional embodiments of the present invention.

FIG. 4 is a view illustrating a selector 130-1 according to one or more embodiments of the present invention.

Referring to FIG. 4, the selector 130-1 may be or comprise a multiplexer. The selector 130-1 may select two or more of a plurality of first latches and provide data stored in the two or more selected first latches respectively to a plurality of level shifters.

For example, the number of first latches selected by the selector 130-1 may be equal to the number of level shifters, and the selected first latches may not overlap.

The level shifter 140 may include a plurality of level shifters SH1 to SHp (p being a natural number that satisfies $1<p\leq n$).

The level shifters SH1 to SHp may respectively correspond to the first groups (e.g., the first latches FL11-FL13, FL21-FL23, to FLk1-FLk3.

The level shifters SH1 to SHp may convert the voltage level of the data from the first latches FL11 to FLk3 and provided by the selector 130, and output the voltage level-converted data.

The second latch unit 150 may include a plurality of second latches SL11 to SLk3 (k being a natural number that satisfies k>1, and that may be the same as for the first latch unit 120).

The second latches SL11 to SLk3 may be grouped into a plurality of second groups each including two or more (for example, 3) second latches.

The second groups may respectively correspond to the level shifters and to the first groups. The number of second latches included in each second group may be equal to the number of first latches included in each first group.

Data output from each of the level shifters SH1 to SHp may be stored in one of the second latches in each second group corresponding to the level shifter.

One of the second latches included in each second group may be enabled in such a manner that corresponding second latches of the respective second groups are simultaneously enabled, and the other second latches included in each second group are disabled.

In response to second control signals SN1 to SN3 from the timing controller, one of the second latches included in each second group (e.g., SL11, SL21, . . . SLk1) may be enabled, and the other second latches may be disabled. The enabled second latch may store the data from a level shifter corresponding to the second group.

Although three second control signals (for example, SN1 to SN3) are illustrated in FIG. 2, the number of second control signals is not limited thereto, and may be equal to the number of second latches included in each second group.

The data stored in second latches SL11 to SLk1 may be simultaneously provided to the digital-to-analog conversion unit 160 in response to a third control signal LD from the timing controller.

The digital-to-analog conversion unit 160 may include a plurality of digital-to-analog converters DAC1 to DACn (n being a natural number that satisfies n>1). Each of the digital-to-analog converters DAC1 to DACn may convert the digital data stored in a corresponding one of the second latches SL11 to SLk3 into an analog signal.

The output unit 170 may include a plurality of amplifiers or buffers A1 to An (n being a natural number that satisfies n>1). Each of the amplifiers/buffers A1 to An may amplify or buffer the analog signal output from a corresponding one of the digital-to-analog converters DAC1 to DACn and output the amplified or buffered signal.

Figure 3:
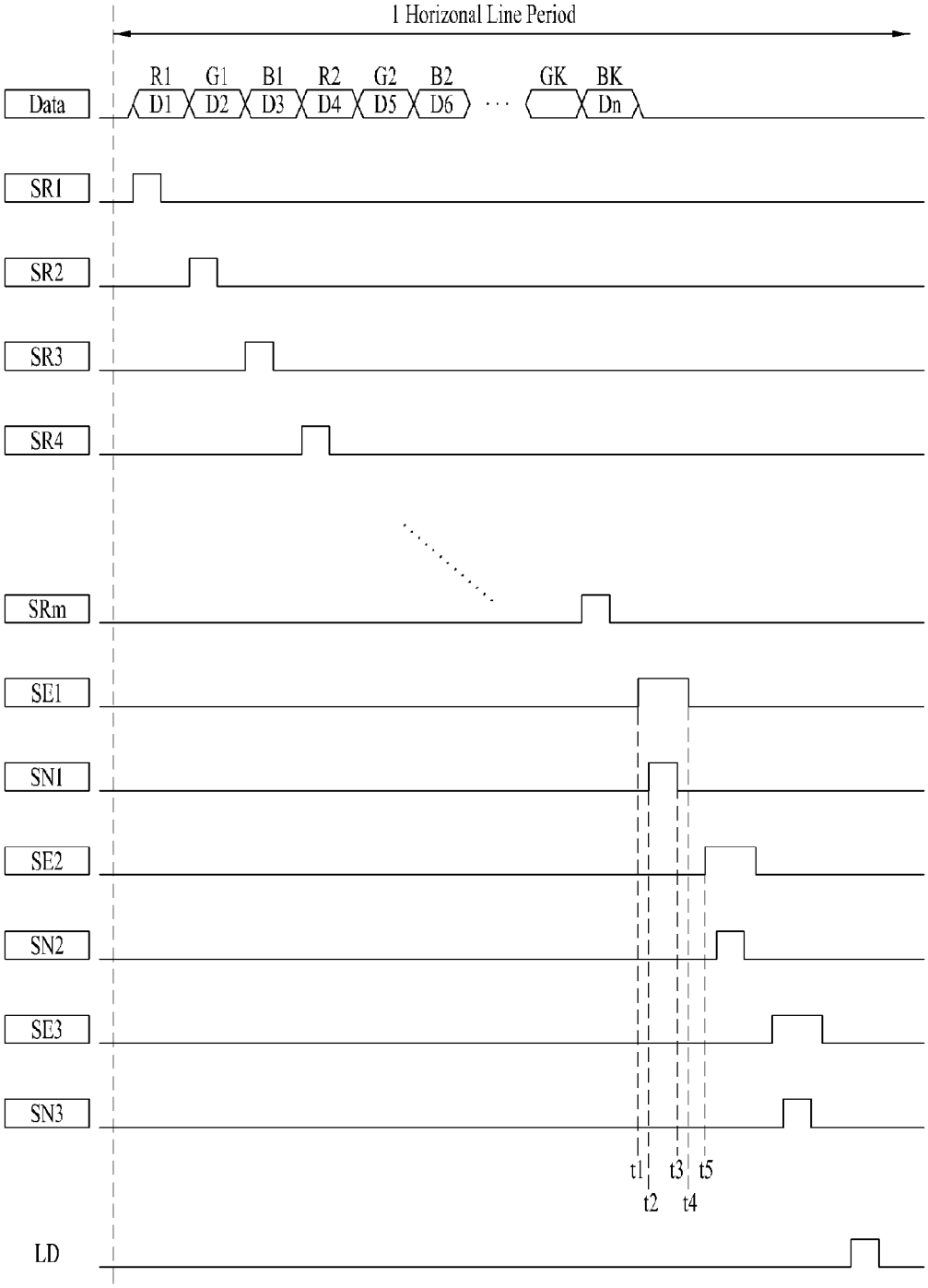
FIG. 3 is a timing diagram of exemplary signals for driving the data driver illustrated in FIG. 2.

FIG. 3 is a timing diagram of signals for driving the data driver 100 illustrated in FIG. 2.

Referring to FIG. 3, due to the shift signals SR1 to SRm, the data D1 to Dn from the external source (e.g., an image sensor, display controller, timing controller, etc.) may be respectively stored in the first latches FL11 to FLk3.

The first control signals SE1 to SE3 may be provided to the first latch unit 120 sequentially or at a certain time interval. For example, a certain time interval may exist between one of two adjacent first control signals (or an edge thereof; for example, disable timing edge t4) and the other of the two adjacent first control signals (or an edge thereof; for example, enable timing edge t5).

A first control signal (for example, SE1) and a second control signal (for example, SN1) respectively provided to a first group of latches and second group of latches that, in turn, correspond to one of a plurality of level shifters, may correspond to each other.

Each of the second control signals (e.g., SN1, SN2, SN3, etc.) may be activated during an enable period of a corresponding first control signal (e.g., SE1, SE2, SE3, etc.).

Each of the second control signals (e.g., SN1, SN2, etc.) may be enabled at a first timing t2 (e.g., a first period of time t2−t1) after an enable timing t1 (e.g., a rising edge) of the corresponding first control signal (e.g., SE1) and be disabled at a second timing t3 (e.g., a second period of time t4−t3) before a disable timing t4 (e.g., a falling edge) of the corresponding first control signal.

This serves to prevent data loss by allowing a level shifter (for example, SH1) to perform a level shifting operation until all data (for example, R1) output from the level shifter SH1 is completely stored in a second latch (for example, SL11), and before any data from another latch in the same first group (e.g., G1) is voltage level-shifted by the level shifter (e.g., SH1).

As described above, since one level shifter performs a level shifting operation a number of times (for example, three times) for one horizontal line period (e.g., by time division), the number of level shifters may be reduced, the chip size of the data driver may also be reduced, and manufacturing costs may be reduced.

In addition, since the number of control signals can be a total of only two times the number of latches in a group (e.g., six, for example, SE1 to SE3, and SN1 to SN3) for the time division function applied to the level shifters, the performance of the data driver 100 is not greatly influenced.

Figure 5:
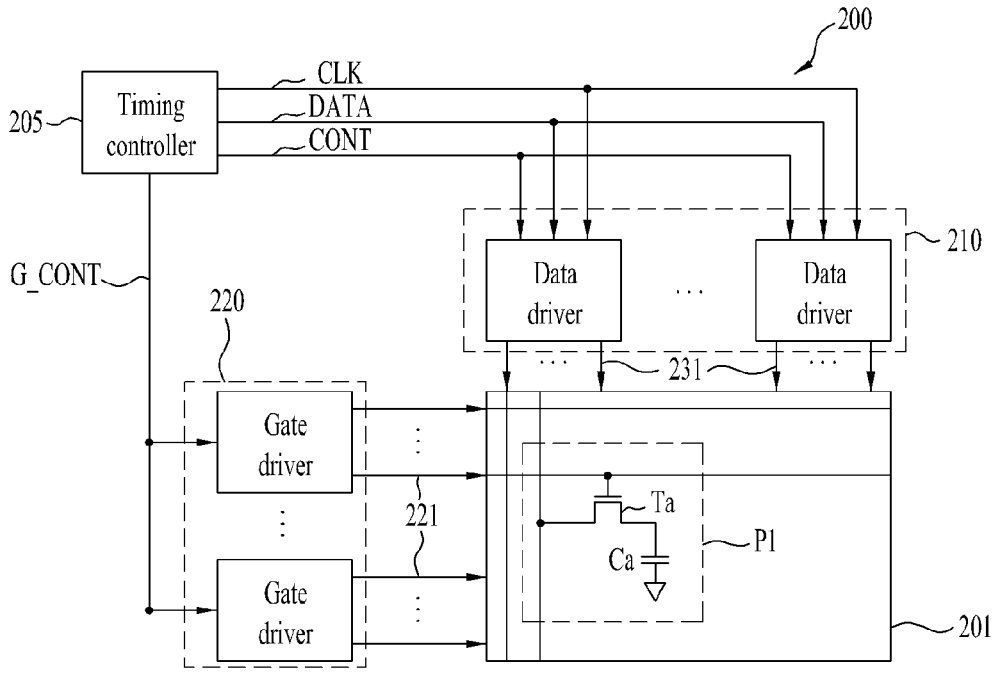
FIG. 5 is a view illustrating a display device including a plurality of data drivers according to one or more embodiments of the present invention.

FIG. 5 is a view illustrating an exemplary display device 200 including a plurality of data drivers, according to one or more embodiments of the present invention.

Referring to FIG. 5, the display device 200 includes a display panel 201, a timing controller 205, a data driving unit 210, and a gate driving unit 220.

The display panel 201 may have a matrix of pixels (for example, P1) respectively connected to gate lines 221 aligned in rows and data lines 231 aligned in columns crossing the gate lines 221. The pixels P1 may be plural in number, and each pixel P1 may include a transistor Ta and a capacitor Ca.

The timing controller 205 outputs a clock signal CLK, pixel data DATA, a data control signal CONT configured to control the data driving unit 210, and a gate control signal G_CONT configured to control the gate driving unit 220.

For example, the data control signal CONT may include the start signal input to the shift register 110, the first control signals SE1 to SE3, the second control signals SN1 to SN3, and the third control signal LD.

The data driving unit 210 may include a plurality of data drivers, receive data from the timing controller 205, generate an analog signal corresponding to the received data, and provide the analog signal to the data lines 131. Each of the data drivers may be the same as the data driver 100 illustrated in FIG. 1.

The gate driving unit 220 may include a plurality of gate drivers, each receiving the gate control signal G_CONT and outputting a gate or row select signal configured to control the transistor Ta of each pixel P1 on the gate lines.

Since the number of level shifters in each of the data drivers may be reduced, the area of the data driving unit 210 of the display device 200 may be reduced, and manufacturing costs may also be reduced.

As is apparent from the above description, the size of the data driver may be reduced without a reduction in performance, and thus chip manufacturing costs may also be reduced.

It will be apparent to those skilled in the art that various modifications and variations can be made in the present invention without departing from the spirit or scope of the inventions. Thus, it is intended that the present invention covers modifications and variations of this invention, provided they come within the scope of the appended claims and their equivalents.

What is claimed is:

1. A data driver comprising:

a first latch unit comprising a plurality of first groups, wherein each of the first groups includes two or more first latches configured to store data;

a level shifter unit comprising a plurality of level shifters configured to convert a voltage level, wherein each of the plurality of level shifters corresponds to one of the first groups;

a selector including a plurality of switches, each of the plurality of switches being between one of the first latches in each first group and the level shifter corresponding to the first group and providing data from one of the first latches in each first group to the corresponding one of the plurality of level shifters;

a second latch unit comprising a plurality of second groups, wherein each of the second groups corresponds to one of the plurality of level shifters and includes second latches; and a timing controller configured to generate first control signals that control operations of the plurality of switches and second control signals that simultaneously enable one of the second latches in each second group, wherein one of the second latches in each second group is simultaneously enabled, and the enabled one of the second latches in each second group stores data output from the corresponding one of the plurality of level shifters.

2. The data driver according to claim 1, wherein the second latch unit has a driving voltage higher than a driving voltage of the first latch unit.

3. The data driver according to claim 1, wherein other second latches in each second group are disabled when the one of the second latches in each second group is enabled.

4. The data driver according to claim 1, wherein a number of the plurality of level shifters is less than a number of the first latches.

5. The data driver according to claim 1, wherein each of the first groups comprises three first latches, and the first latches in each first group respectively store red (R), green (G), and blue (B) data.

6. The data driver according to claim 1, wherein the selector is configured to sequentially provide the data in the first latches in each first group to the level shifter corresponding to the first group.

7. The data driver according to claim 1, wherein each of the second control signals is enabled after an enable timing of the corresponding one of the first control signals, and is disabled before a disable timing of the corresponding first control signal.

8. The data driver according to claim 1, further comprising:

a digital-to-analog converter configured to convert an output of the second latch unit into an analog signal; and an output unit configured to amplify the analog signal output from the digital-to-analog converter, and output the amplified analog signal.

9. A data driver comprising:

a first latch unit comprising a plurality of first groups, wherein each of the first groups includes first latches configured to store data;

a level shifter unit comprising a plurality of level shifters configured to convert a voltage level of input data and output the voltage level-converted data, wherein each of the plurality of level shifters corresponds to one of the first groups;

a selector including a plurality of switches, each of the plurality of switches being between one of the first latches in each first group and the level shifter corresponding to the first group and providing data from one of the first latches in each first group to the corresponding one of the plurality of level shifters;

a second latch unit comprising a plurality of second groups, wherein each of the second groups corresponds to one of the plurality of the level shifters and includes second latches;

a digital-to-analog converter configured to convert an output of the second latch unit into an analog signal;

an output unit configured to amplify the analog signal output from the digital-to-analog converter, and output the amplified analog signal; and a timing controller configured to generate first control signals that control operations of the plurality of switches and second control signals that simultaneously enable one of the second latches in each second group, wherein one of the second latches in each second group is simultaneously enabled, and the enabled one of the second latches in each second group stores the data output from the corresponding level shifter.

10. The data driver according to claim 9, wherein one of the plurality of level shifters corresponding to each first group shifts the voltage level of the data in the first latches in the first group for one horizontal line period.

11. The data driver according to claim 9, wherein a number of the plurality of level shifters is equal to a number of the plurality of first groups.

12. The data driver according to claim 9, wherein the selector sequentially selects the first latches in each first group and provides the data in the selected first latches to the corresponding one of the plurality of level shifters.

13. A data driver comprising:

a plurality of first latch groups, wherein each of the first latch groups includes first latches configured to store data;

a plurality of level shifters configured to convert a voltage level, each of the plurality of level shifters corresponding to one of the first latch groups;

a selector including a plurality of switches, each of the plurality of switches being between one of the first latches in each first group and the level shifter corresponding to the first group and providing data from one of the first latches in each first latch group to the corresponding one of the plurality of level shifters;

second latch groups, each corresponding to one of the plurality of level shifters, each of second latch groups including second latches; and a timing controller configured to generate first control signals that control operations of the plurality of switches and second control signals that simultaneously enable one of the second latches in each second latch group, wherein the one of the second latches in each second latch group enabled by the second control signals stores data output from the corresponding level shifter.

14. The data driver according to claim 13, wherein each of the first control signals is enabled after an enable timing of a corresponding one of the second control signals, and is disabled before a disable timing of the corresponding second control signal.

15. The data driver according to claim 13, wherein the timing controller generates a third control signal, and data stored in the second latches of the second latch groups are simultaneously provided to the digital-to-analog conversion unit in response to the third control signal.

* * * * *